United States Patent [19]

Kawai

[11] 4,117,821

[45] Oct. 3, 1978

[54] ENGINE STARTING SYSTEM

[75] Inventor: Michio Kawai, Yokohama, Japan

[73] Assignee: Nissan Motor Company, Limited, Yokohama, Japan

[21] Appl. No.: 743,098

[22] Filed: Nov. 19, 1976

[30] Foreign Application Priority Data

Nov. 20, 1975 [JP] Japan ..... 50-139514

[51] Int. Cl.[2] ..... F02N 17/00

[52] U.S. Cl. ..... 123/179 L; 123/179 A; 123/179 G

[58] Field of Search ..... 123/179 A, 179 G, 179 L, 123/179 M, 198 D

[56] References Cited

U.S. PATENT DOCUMENTS

| | | | |
|---|---|---|---|
| 2,016,231 | 10/1975 | Ferguson | 123/179 A |
| 2,148,816 | 2/1939 | Jorgensen | 123/179 A |
| 2,195,927 | 4/1940 | Hurst et al. | 123/179 G |
| 2,939,446 | 6/1960 | Dolza | 123/179 L |
| 2,945,484 | 7/1960 | Scherenberg et al. | 123/179 L |
| 3,593,697 | 7/1971 | Ciolli | 123/179 BG |
| 3,614,946 | 10/1971 | Standt et al. | 123/179 L |
| 3,707,144 | 12/1972 | Gallis et al. | 123/179 L |
| 3,814,072 | 6/1974 | Gillespie | 123/179 L |
| 3,973,546 | 8/1976 | Scott | 123/198 D |

*Primary Examiner*—Charles J. Myhre
*Assistant Examiner*—David D. Reynolds
*Attorney, Agent, or Firm*—Lane, Aitken, Dunner & Ziems

[57] ABSTRACT

A common actuator is provided for connecting a starter motor to an engine and concurrently for operating means for temporarily effecting an increase in the amount of injected fuel to a value for starting the engine and a safety device is provided for preventing the actuator and the starter motor for being actuated even if a starter key switch is erroneously switched on after the starting of the engine has been completed.

9 Claims, 4 Drawing Figures

ENGINE STARTING SYSTEM

The present invention relates generally to a starting system for an engine such as a diesel engine and particularly to a starting system of this type which is improved to have a common actuator effect connection and disconnection of a starter motor to and from the engine, respectively and operate means for temporarily effecting an increase in the amount of injected fuel to a value for starting the engine and is further improved to comprise a switch for preventing the common actuator and the starter motor from being actuated even if a starter key switch is erroneously switched on by an operator during operations of the engine after the engine has started.

As is well known in the art, an engine such as a diesel engine is provided with a starting system to temporarily effect an increase in the amount of injected fuel to a value for starting the engine as well as to connect a starter motor to the engine and to actuate the starter motor.

A conventional starting system of this type has comprised two separate actuators performing two functions, respectively, of connecting a starter motor to an engine and of operating means for temporarily effecting an increase in the amount of injected fuel until the engine starts. As a result, the construction of the starting system has been complicated. Furthermore, in the conventional starting system, when a starter key switch is erroneously switched on by an operator during operations of the engine after the engine has started, the actuators and the starter motor are actuated so that a pinion driven by the starter motor strikes against a gear driven by the engine to damage the pinion and the gear and concurrently the amount of injected fuel is undesirably increased to produce black smoke.

It is, therefore, an object of the invention to provide a starting system for an engine which is improved to comprise a common actuator serving to connect and disconnect a starter motor to and from the engine, respectively and concurrently to operate means for temporarily effecting an increase in the amount of injected fuel to a value for starting the engine.

It is a further object of the invention to provide an engine starting system which is improved to further comprises a safety device for preventing the actuator and the starter motor from being actuated even if a starter key switch is erroneously switched on during operations of the engine after the engine has started.

These and other objects and advantages of the invention will become more apparent from the following detailed description taken in connection to the accompanying drawings in which.

Figure 1:
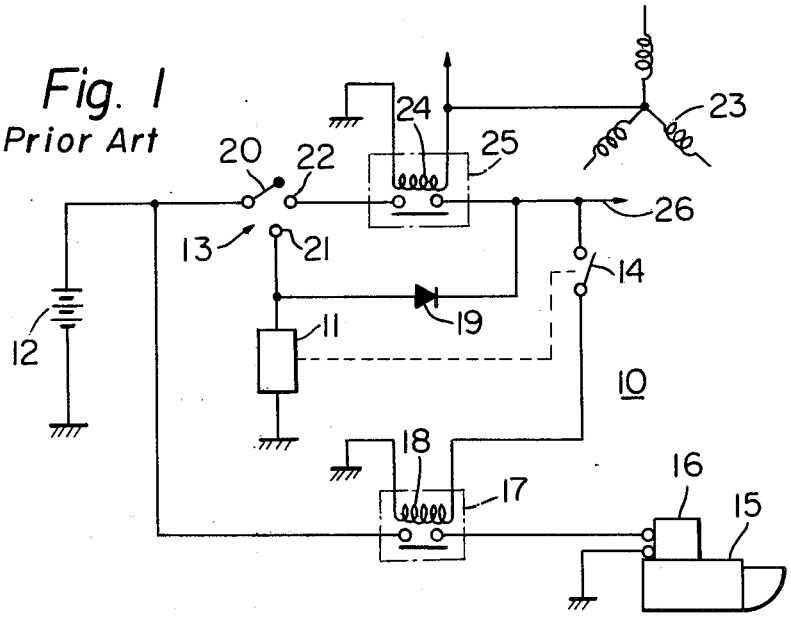
Fig. 1 Prior Art
FIG. 1 is a schematic view of a conventional engine starting system.

Referring to FIG. 1 of the drawings, there is shown a prior art engine starting system as per the introduction of the present specification. As shown in FIG. 1, the prior art engine starting system, generally designated by the reference numeral 10, comprises an actuator 11 for operating means (not shown) for temporarily effecting an increase in the amount of injected fuel to a value for starting an engine (not shown) equipped with the starting system 10. The actuator 11 includes a solenoid (not shown) electrically connected to a storage battery 12 through a starter key switch 13. A turn switch 14 is connected to the actuator 11 and is closed in response to energization of the solenoid of the actuator 11. A starter motor 15 includes an actuator 16 for connecting and disconnecting a pinion (not shown) of the starter motor 15 to and from a gear (not shown) mounted on a shaft driven by the engine. The starter motor 15 and the actuator 16 are electrically connected to the storage battery 12 through a normally open relay switch 17. A relay coil 18 of the relay switch 17 is electrically connected to the starter key switch 13 through the turn switch 14 and a diode 19. When the starter key switch 13 is switched on to engage a movable contact 20 with a starting stationary contact 21, the solenoid of the actuator 11 is energized so that the actuator 11 is actuated to temporarily increase the amount of injected fuel to a value for starting the engine. The turn switch 14 is closed by energization of the solenoid of the actuator 11 so that the relay coil 18 is energized to close the relay switch 17. The actuator 16 is actuated by closing of the relay switch 17 to mesh the pinion of the starter motor 15 with the gear of the engine and subsequently to actuate the starter motor 15. As a result, the engine starts. When it is felt that the engine has started, the starter key switch 13 is switched off to engage the movable contact 20 with a second stationary contact 22. As a result, the solenoid of the actuator 11 is deenergized to return the amount of injected fuel to a normal value for normal operations of the engine. Concurrently, the turn switch 14 is opened so that the relay coil 18 is deenergized to open the relay switch 17 to stop the rotation of the starter motor 15. Since, when the starting of the engine is completed, an output voltage of an alternator 23 is increased to a predetermined value, a relay coil 24 of a normally open relay switch 25 is energized to close the relay switch 25 to feed an output terminal 26 with an electric current from the battery 12 (alternator 23).

Since the prior art engine starting system 10 has thus comprised the two actuators 16 and 11 provided respectively for connecting and disconnecting the starter motor 15 to and from the engine and for operating the means for temporarily increasing the amount of injected fuel to a value for starting of the engine, the construction of the starting system 10 has been complicated. Furthermore, the starting system 10 has required a minute adjustment so that the maintenance and inspection of the system 10 have been difficult. Still furthermore, when the starter key switch 13 is erroneously switched on during operations of the engine after the engine has started, the actuators 11 and 16 are actuated so that the amount of fuel injected is undesirably increased to cause the production of black smoke and concurrently the starter motor 15 is connected to the engine and is actuated to damage the pinion of the starter motor 15 and the gear of the engine.

Figure 2:
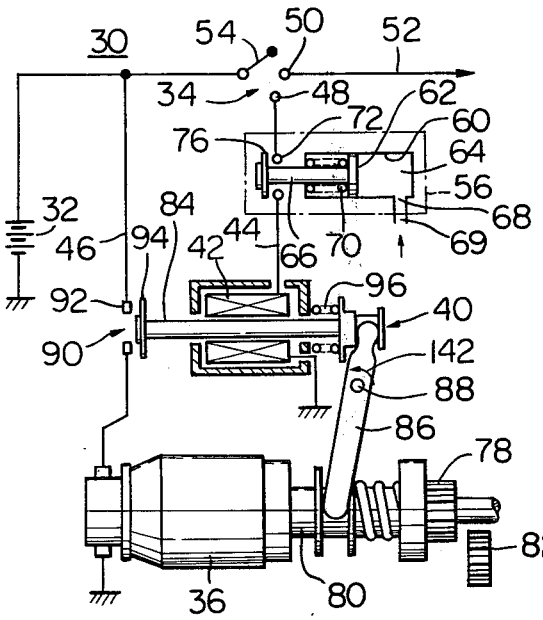
FIG. 2 is a schematic view of a part of a preferred embodiment of an engine starting system according to the invention.
Figure 3:
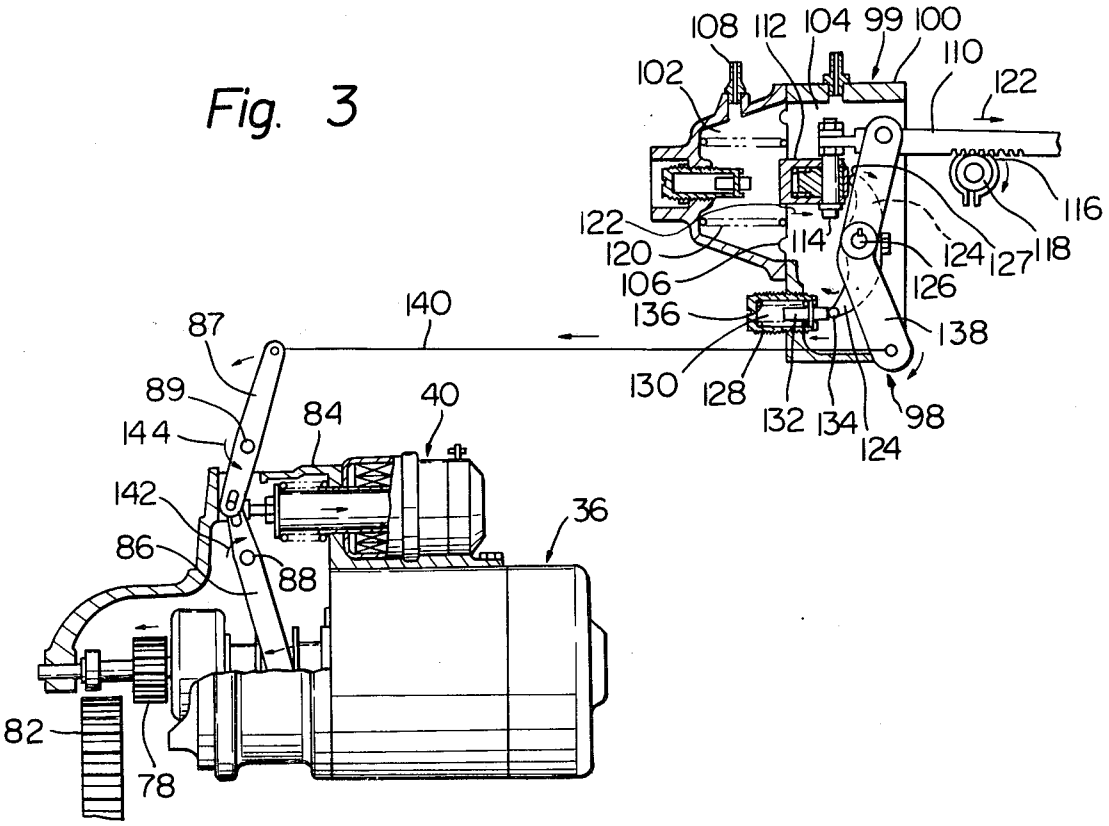
FIG. 3 is a schematic view of the other part of the preferred embodiment of the engine starting system according to the invention.

Referring to FIGS. 2 and 3 of the drawings, there is shown a starting system according to the invention. The starting system, generally designated by the reference numeral 30, comprises an electric power source 32 such as a storage battery, a starter key switch 34, a starter motor 36 and an actuator 40 which has a solenoid 42 for actuating the actuator 40. The starting system 30 also comprises an actuator control electric circuit 44, which includes the solenoid 42, for energizing the solenoid 42, and a starter motor control electric circuit 46, which includes the starter motor 36, for operating the starter motor 36. The control circuits 44 and 46 also include the electric power source 32. The starter key switch 34 is included in the control circuit 44 between the electric power source 32 and the solenoid 42 and serves, when is manually closed, to cause the operation of the starter motor 36 and the energization of the solenoid 42. The starter key switch 34 has a first stationary contact 48 provided in the control circuit 44, a second stationary contact 50 provided in a different circuit 52, and a movable contact 54 connected to the electric power source 32. The movable contact 54 is engaged with the starting stationary contact 48 when the starter key switch 34 is switched on by the operator for starting an engine (not shown) such as a diesel engine which is equipped with the starting system 30. The movable contact 54 is disengaged from the first stationary contact 48 and is engaged with the second stationary contact 50 in known manner when the starter key switch 34 is switched off by the operator after the engine has started or has run.

A safety device 56 is provided in the control circuit 44 between the starter key switch 34 and the solenoid 42 and controls both the control circuits 44 and 46. The safety device 56 is a hydraulically operated switch and serves to automatically open the control circuits 44 and 46 to stop the operation of the starter motor 36 and the energization of the solenoid 42 when the starting of the engine has been completed. The control switch 56 comprises means such as a housing (not shown) defining a bore 60, a piston 62 slidably fitted in the bore 60 and defining in the bore 60 a fluid chamber 64 filled with pressurized hydraulic fluid, and a piston rod 66 extending from the piston 62 externally of the bore 60. The fluid chamber 64 has an inlet port 68 opening thereinto and communicating with a line or passage means 69 for conducting pressurized hydraulic fluid such as lubricating oil fed from a pressurized hydraulic fluid source such as a pump which is driven by the engine. As a result, the piston 62 is moved in opposite directions in accordance with the pressure in the fluid chamber 64. A spring 70 is provided to urge the piston 62 toward the fluid chamber 64. The switch 56 has first and second stationary contacts 72 spaced from each other and electrically connected respectively to the contact 48 and the solenoid 42, and a movable contact 76 fixedly secured to an external end of the piston rod 66. The movable contact 76 is engaged against the stationary contacts 72 by the force of the spring 70 to close the switch 56 when the starting of the engine is not completed and accordingly the pressure of hydraulic fluid in the fluid chamber 64 and accordingly the hydraulic fluid line 69 is below a predetermined value. The piston 62 is moved by the hydraulic fluid pressure in the chamber 64 in opposition to the force of the spring 70 to disengage the movable contacts 76 from the stationary contact 72 to open the switch 56 when the starting of the engine has been completed so that the hydraulic fluid pressure in the fluid chamber 64 and the hydraulic fluid line 69 has reached the predetermined value.

The starter motor 36 includes a driving gear or pinion 78 driven by the motor 36 and slidably supported on an output shaft 80 of the motor 36. The pinion 78 is normally disengaged from a driven gear 82 such as a ring gear for driving the engine and, when the engine is started, is moved to engage the driven gear 82.

The actuator 40 comprises an actuation rod 84 extending through the solenoid 42 and consituting an armature of the solenoid 42, and first and second levers 86 and 87 pivotably connected at their ends to one end of the operating rod 84 and rotatably supported at their mid portions respectively on first and second fulcrums 88 and 89. The first lever 86 is operatively connected at the other end to the pinion 78 to shift it along the output shaft 80 in opposite directions. A starter motor control switch 90 is included in the control circuit 46 between the electric power source 32 and the starter motor 36 and comprises first and second stationary contacts 92 spaced from each other and electrically connected respectively to the source 32 and the starter motor 36, and a movable contact 94 fixedly secured to the other end of the operating rod 84 and engageable with the stationary contacts 92. A spring 96 is provided to urge the operating rod 84 into a dormant or normal position shown in FIG. 2 in which the pinion 78 and the movable contact 94 are disengaged respectively from the gear 82 and the stationary contacts 92, respectively.

The starting system 30 also comprises a device 98 for temporarily effecting an increase in the amount of fuel fed to a combustion chamber of the engine during starting operation of the engine in which the engine is driven by the starter motor 36. The device 98 cooperates with a device 99 for controlling the flow of fuel injected during operations of the engine. The device 99 comprises a housing 100 having first and second chambers 102 and 104, and a flexible diaphragm 106 separating the chambers 102 and 104 from each other. The chamber 102 is fed through an inlet port 108 with a control fluid such as a vacuum in an intake passageway of the engine which fluid is a parameter representative of a function of an operating condition such as the output torque demand of the engine. The chamber 104 communicates with, for example, the atmosphere. The diaphragm 106 is operatively connected to a control rack 110 through suitable fastening means such as a bracket 112 and a pin 114 and moves the control rack 110 in one direction to effect an increase in the fuel flow and in another direction to effect a decrease in the fuel flow in accordance with the control fluid in the chamber 102. The control rack 110 is meshed with a pinion 116 fixedly secured to a control shaft 118 which adjusts the flow of fuel injected. A spring 120 is provided to urge the diaphragm 106 and the control rack 110 in the one direction in which the flow of fuel injected is increased, as shown by the arrow 122. An adjusting lever 124 is fixedly secured at its mid portion to a shaft 126 rotatably supported by the housing 100 so that it is rotatable together with the shaft 126. The adjusting lever 124 is engaged at one end 127 with the diaphragm 106 through the bracket 112. An adjusting screw 128 for adjusting the flow of injected fuel to prevent the production of smoke is attached to the housing 100 and is formed therein with a bore 130. A pin 132 axially movably extends from the inside of the bore 130 outside of the bore 130 and is engaged at one end with the other end 134 of the adjusting lever 124. A spring 136 is provided to urge the pin 132 in a direction in which the adjusting lever 124 is urged angularly about the axis of the shaft 126 counterclockwise in the drawing in this embodiment so that the end 127 of the adjusting lever 124 is urged in a direction opposite to the direction of the action of the spring 120 or in a direction to cause a reduction in the flow of fuel injected. The flow of fuel injected is controlled during normal operations of the engine under the balance among the difference of the pressures of fluid in the chambers 102 and 104 and the forces of the springs 120 and 136.

The device 98 comprises a lever 138 mounted on the shaft 126. The second lever 87 of the actuator 40 is operatively connected to the lever 138 through a mechanical linkage 140 and the lever 138 is operatively connected to the shaft 126 so that when the actuator 40 is actuated for starting the engine to move the second lever 87 in a direction shown by the arrow 140, the lever 138 is rotated about the axis of the shaft 126 from a normal position into an engine starting position clockwise in the drawing in this embodiment to rotate the shaft 126 and the adjusting lever 124 from a normal position into an engine starting position to thereby move the end 127 of the adjusting lever 124 away from the diaphragm 106. The lever 138 is urged toward the normal position by, for example, a spring (not shown).

The starting system 30 thus far described is operated as follows:

When the starter key switch 34 is switched on for starting the engine, the movable contact 54 is engaged with the first stationary contact 48 to complete the control circuit 44 since the switch 56 is closed at this time. As a result, the solenoid 42 of the actuator 40 is energized to move the operating rod 84 from the dormant position shown in FIG. 2 into an engine starting position to close the switch 90 and concurrently to swing the levers 86 and 87 about the fulcrums 88 and 89 in the directions shown by the arrows 142 and 144, respectively. The pinion 78 is meshed with the gear 82 by swinging of the lever 86 and the starter motor 36 is rotated by closing of the switch 90. On the other hand, the lever 138 is rotated clockwise about the axis of the shaft 126 into the engine starting position by swinging of the lever 87 so that the lever 124 is rotated clockwise about the axis of the shaft 126 into the engine starting position. The end 127 of the lever 124 is moved away from the diaphragm 106 by rotation of the lever 124 to allow the spring 120 to move the diaphragm 106 in the direction of the arrow 122. The control rack 110 is moved in the direction of the arrow 122 by movement of the diaphragm 106 to rotate the pinion 116 clockwise in the drawing to increase the amount of fuel injected.

Thus, the engine is driven by the starter motor 36 with an increased amount of fuel fed into a combustion chamber of the engine. When the starter key switch 34 is switched off by the operator which has felt that the engine has started, the movable contact 54 is disengaged from the stationary contact 48 and is engaged with the stationary contact 50 to open the control circuit 44. As a result, the solenoid 42 is deenergized to cause the spring 96 to return the operating rod 84 into the dormant position. Accordingly, the switch 90 is opened to stop operation of the starter motor 36 and concurrently the levers 86 and 87 are rotated about the fulcrums 88 and 89, respectively to disengage the pinion 78 from the gear 82 and to rotate the levers 138 and 124 about the axis of the shaft 126 into the normal position to return the amount of fuel injected into a normal value for normal operations of the engine.

When the pressure of hydraulic fluid in the hydraulic fluid line 69 is increased above the predetermined value by the completion of starting of the engine, the switch 56 is opened by the piston 62 to deenergize the solenoid 42 of the actuator 40 when the starter key switch 34 is not still switched off by the operator. As a result, even if the starter key switch 34 is erroneously switched on to engage the movable contact 54 with the stationary contact 48 during operations of the engine after the engine has started, since the switch 56 is opened the solenoid 42 of the actuator 40 is not energized so that the starter motor 36 is prevented from being actuated and the amount of fuel injected is prevented from being increased to a value for starting of the engine. Thus, the damage of the pinion 78 and the gear 82 and the production of undesirable black smoke are surely prevented.

Figure 4:
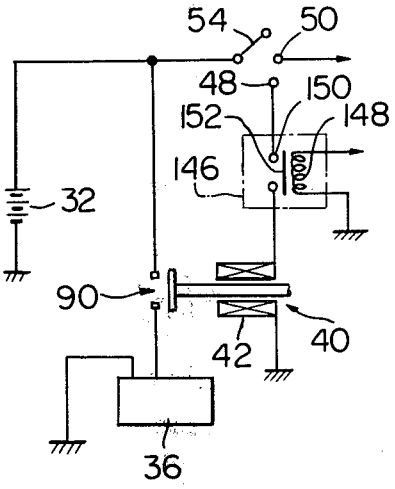
FIG. 4 is a schematic view of an other example of a control switch forming a part of the engine starting system shown in FIG. 2.

Referring to FIG. 4 of the drawings, there is shown another example of the control switch 56 described with respect to and illustrated in FIG. 2. As shown in FIG. 4, the control switch 146 comprises a normally closed relay switch comprising a relay coil 148 electrically connected to a neutral point of a stator coil or to an output terminal of an alternator (not shown) driven by the engine, first and second stationary contacts 150 spaced from each other and electrically connected respectively to contact 48 and the solenoid 42, and a movable contact 152 operated by the relay coil 148 and engageable with the stationary contacts 150. The movable contact 152 is normally engaged against the stationary contacts 150 to close the switch 146 and is disengaged from the stationary contacts 150 by the relay coil 148 to open the switch 146 when an output voltage of the alternator has reached a predetermined value by the completion of starting of the engine. In FIG. 4, like component elements are designated by the same reference numerals as those used in FIG. 2.

It will be thus appreciated that the invention provides an engine starting system which is improved to comprise a common or combined actuator to connect a starter motor to an engine and concurrently to operate means for temporarily effecting an increase in the amount of injected fuel to a value for starting the engine so that one actuator, a turn switch and so on are dispensed with and accordingly the construction of the starting system is simplified.

It will be still appreciated that the invention provides an engine starting system which is improved to further comprise a safety device for preventing the actuator and the starter motor from being actuated even if a starter key switch is erroneously switched on after the engine has started so that a malfunction of a starter motor and supply of an excessive amount of fuel to the engine are surely prevented to lengthen the life time of the starter motor and prevent the production of black smoke.

What is claimed is:

1. A starting system for an engine, comprising:

a starter motor for starting said engine;

first means for temporarily effecting an increase in the amount of fuel fed to a combustion chamber of said engine to a value for starting said engine;

a common actuator, including an electrically-activated solenoid, operatively connected to said starter motor and to said first means, and having a starting position into which said common actuator is movable and in which said common actuator connects said starter motor to said engine and concurrently operates said first means;

second means for moving said common actuator into said starting position, said second means including an electric power source and a starter key switch electrically connected to said electric power source and to said solenoid to energize said solenoid when said starter key switch is closed;

third means for actuating said starter motor; and an operating rod operatively connected to said starter motor and to said first means and located with respect to said solenoid to be moved into said starting position in response to energization of said solenoid.

2. A starting system as claimed in claim 1, wherein said starter motor comprises a pinion slidably mounted on an output shaft of said starter motor and having a starting position for meshing with a gear for driving said engine, said first means comprises a control member movable in one direction to effect an increase in the amount of said fuel and in another direction to effect a decrease in the amount of said fuel, a flexible diaphragm operatively connected to said control member and responsive to the torque demand of said engine to move said control member in said one and another directions, biasing means for urging said diaphragm and said control member in said one direction, a first lever rotatably engaging said diaphragm and urging said diaphragm and said control member in said another direction, and a second lever for rotating said first lever away from said diaphragm to allow said biasing means to move said diaphragm and said control member in said one direction to temporarily effect said increase in the amount of said fuel, and said common actuator comprises first and second levers pivotally connected at their ends respectively to said operating rod and rotatably supported at their mid portions respectively on first and second fulcrums to be rotated about said fulcrums when said operating rod is moved into said starting position, said first lever of said common actuator being operatively connected at the other end to said pinion of said starter motor to move said pinion into said starting position when rotated, said second lever of said common actuator being operatively connected at the other end to said second lever of said first means to rotate said second lever thereof when rotated.

3. A starting system as claimed in claim 1, in which said starter motor comprises a pinion slidably mounted on an output shaft of said starter motor and having a starting position for meshing with a gear for driving said engine, said first means comprises a control member movable in one direction to effect an increase in the amount of said fuel and in another direction to effect a decrease in the amount of said fuel, biasing means for urging said control member in said one direction, a first lever rotatably engaging said control member and urging said control member in said another direction, and a second lever for rotating said first lever in said one direction to allow said biasing means to move said control member in said one direction to temporarily effect said increase in the amount of said fuel, and said common actuator comprises first and second levers pivotably connected at their ends respectively to said operating rod and rotatably supported at their mid portions respectively on first and second fulcrums to be rotated about said fulcrums when said operating rod is moved into said starting position, said first lever of said common actuator being operatively connected at the other end to said pinion of said starter motor to move said pinion into said starting position when rotated, said second lever of said common actuator being operatively connected at the other end to said second lever of said first means to rotate said second lever thereof when rotated.

4. A starting system for an engine, comprising:

starter switch means;

a starter motor for starting said engine;

second switch means having one part electrically connected to said starter motor and the other part engageable with and disengageable from said one part for closing and opening said second switch means to energize and deenergize said starter motor, respectively;

fuel supply control means operable for temporarily effecting an increase in the amount of fuel fed to said engine to a value suitable for starting said engine;

common actuating means operatively connected to said starter motor and fixedly secured to said other part of said second switch means and operatively connected to said fuel supply control means, and having a reset position in which said common actuating means disconnects said starter motor from said engine and concurrently disengages said one part of said second switch means from said other part thereof and prevents said feul supply control means from temporarily effecting said increase, and having a starting position in which said common actuating means connects said starter motor to said engine and concurrently engages said one part of said second switch means against said other part thereof and causes said fuel supply control means to temporarily effect said increase; and solenoid means electrically connected to said starter switch means for causing said common actuating means to move from said rest position into said starting position when said starter switch means is closed.

5. A starting system as claimed in claim 4, in which said starter switch means comprises a starter key switch and said solenoid means comprises a solenoid, said starting system further comprising a safety device located between said starter key switch and said solenoid, said safety device being closed before starting of said engine is completed and automatically opened when starting of said engine is completed.

6. A starting system as claimed in claim 5, wherein said safety device comprises a piston having on one side thereof a fluid chamber and movable in opposite directions in accordance with the pressure in said fluid chamber, passage means for feeding into said fluid chamber pressurized hydraulic fluid discharged by a pump driven by said engine, first and second stationary contacts spaced from each other and electrically connected respectively to said starter key switch and said solenoid, and a movable contact connected to said piston and engaged against said stationary contacts by said piston, when the pressure in said fluid chamber is below a predetermined value, to connect said starter key switch to said solenoid and disengaged from said stationary contacts by said piston, when the pressure in said fluid chamber is above said predetermined value, to disconnect said starter key switch from said solenoid.

7. A starting system as claimed in claim 3, wherein said safety device comprises a relay coil, means for electrically interconnecting said relay coil and an alternator driven by said engine, first and second stationary contacts spaced from each other and electrically connected respectively to said starter key switch and said solenoid, and a movable contact controlled by said relay coil and engaged against said stationary contacts, when the output voltage of said alternator is below a predetermined value, to connect said starter key switch to said solenoid and disengaged from said stationary contacts, when the output voltage of said alternator is above said predetermined value, to disconnect said starter key switch from said solenoid.

8. A starting system for an engine, comprising:

starter switch means;

a starter motor for starting said engine;

second switch means comprising:

first and second stationary contacts spaced from each other and electrically connected respectively to an electric power source and said starter motor; and a movable contact engageable with and disengageable from said first and second stationary contacts for closing and opening said second switch means for energizing and deenergizing said starter motor, respectively;

fuel supply control means operable for temporarily effecting an increase in the amount of fuel fed to said engine to a value suitable for starting said engine;

common actuating means operatively connected to said starter motor and to said movable contact of said second switch means and to said fuel supply control means, and having a rest position in which said common actuating means disconnects said starter motor from said engine and concurrently disengages said movable contact from said stationary contacts and prevents said fuel supply control means from temporarily effecting said increase, and having a starting position in which said common actuating means connects said starter motor to said engine and concurrently engages said movable contact with said stationary contacts and causes said fuel supply control means to temporarily effect said increase; and solenoid means electrically connected to said starter switch means for causing said common actuating means to move from said rest position into said starting position when said starter switch means is closed.

9. A starting system as claimed in claim 4, wherein said common actuating means comprises an operating rod constituting an armature of said solenoid means.

* * * * *